US012439985B2

(12) United States Patent
Yu et al.

(10) Patent No.: US 12,439,985 B2
(45) **Date of Patent: *Oct. 14, 2025**

(54) FALSE EYELASH PRE-APPLIED WITH GLUE, GLUE PRE-APPLYING DEVICE AND METHOD FOR PRODUCING FALSE EYELASH PRE-APPLIED WITH GLUE

(71) Applicant: QINGDAO HOLLYREN COSMETICS CO., LTD., Shandong (CN)

(72) Inventors: Chao Yu, Shandong (CN); Tiantian Li, Shandong (CN)

(73) Assignee: QINGDAO HOLLYREN COSMETICS CO., LTD., Qingdao (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/636,188

(22) Filed: Apr. 15, 2024

(65) Prior Publication Data

US 2024/0306750 A1 Sep. 19, 2024

Related U.S. Application Data

(63) Continuation of application No. 18/209,353, filed on Jun. 13, 2023, now Pat. No. 11,986,037.

(30) Foreign Application Priority Data

Mar. 16, 2023 (CN) ..... 202310267085.9
Mar. 16, 2023 (CN) ..... 202320537961.0

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS 6,029,674 A * 2/2000 Han ..... A41G 5/02 446/393
11,986,037 B1 * 5/2024 Yu ..... A41G 5/02

* cited by examiner

*Primary Examiner* — Rachel R Steitz
(74) *Attorney, Agent, or Firm* — IPro, PLLC

(57) ABSTRACT

Disclosed in the present invention are a false eyelash pre-applied with glue, a glue pre-application device and a method for producing the false eyelash pre-applied with glue. The false eyelash pre-applied with glue comprises a false eyelash body and an eyelash bonding portion; the false eyelash body comprises an eyelash stem and a plurality of false eyelashes connected thereto, the false eyelashes bending toward upper surfaces of the false eyelashes; the eyelash bonding portion extends along a length direction of the eyelash stem and is arranged on the upper surfaces of the plurality of false eyelashes near the eyelash stem, and the eyelash bonding portion is configured to bond the false eyelash body to a real eyelash from below the real eyelash.

7 Claims, 12 Drawing Sheets

FALSE EYELASH PRE-APPLIED WITH GLUE, GLUE PRE-APPLYING DEVICE AND METHOD FOR PRODUCING FALSE EYELASH PRE-APPLIED WITH GLUE

TECHNICAL FIELD

The present invention relates to the technical field of beauty products, and in particular, to a false eyelash pre-applied with glue, a glue pre-application device and a method for producing the false eyelash pre-applied with glue.

BACKGROUND

The existing false eyelashes are divided into grafting false eyelashes, self-grafting false eyelashes and paired false eyelashes, all of which use glue to bond the false eyelashes to real eyelashes, so that the false eyelashes are attached to the real eyelashes to achieve the effect of magnifying the eyes and beautifying the makeup. In the process of glue bonding, on the one hand, users need to go through three steps of manual glue application, waiting, and bonding, which takes a long time. On the other hand, the amount of glue for bonding has technical requirements for the users. If there is too much glue for bonding, the users will have an obvious foreign body sensation, and if there is too little glue for bonding, it will easily fall off after wearing, which greatly reduces the user experience.

Therefore, a false eyelash pre-applied with glue, a glue pre-application device and a method for producing the false eyelash pre-applied with glue are developed, so that the users can directly carry out bonding. It is convenient to operate while ensuring a good wearing effect and wearing experience of customers.

SUMMARY

An objective of the present invention is to provide a false eyelash pre-applied with glue, a glue pre-application device and a method for producing the false eyelash pre-applied with glue, so as to solve the problems in the prior art that a wearer needs to apply glue and then wear it during wearing; and due to the influence of the wearer's operation, the wearer will have a foreign body sensation when too much glue is applied, or the false eyelash will fall off easily when too little glue is applied.

In order to achieve the above objective of the present invention, the present invention adopts the following technical solutions:

A false eyelash pre-applied with glue, comprising a false eyelash body and an eyelash bonding portion, wherein the false eyelash body comprises an eyelash stem and a plurality of false eyelashes connected thereto, the false eyelashes bending toward upper surfaces of the false eyelashes;

the eyelash bonding portion extends along a length direction of the eyelash stem and is arranged on the upper surfaces of the plurality of false eyelashes near the eyelash stem, and the eyelash bonding portion is configured to bond the false eyelash body to a real eyelash from below the real eyelash.

A false eyelash pre-applied with glue, comprising a false eyelash body and a bonding assembly, wherein the false eyelash body comprises an eyelash stem and a plurality of false eyelashes connected thereto, the false eyelashes bending toward upper surfaces of the false eyelashes; the bonding assembly comprises an eyelash bonding portion and an eyelash stem bonding portion; the eyelash bonding portion extends along a length direction of the eyelash stem and is arranged on lower surfaces of the plurality of false eyelashes near the eyelash stem, and the eyelash bonding portion is configured to bond the false eyelash body to a real eyelash from above the real eyelash; and the eyelash stem bonding portion extends along the length direction of the eyelash stem and is arranged on the eyelash stem.

In some embodiments of the present application, there are a plurality of eyelash bonding portions, the plurality of eyelash bonding portions are arranged on the plurality of false eyelashes at intervals along an extending direction of the eyelash stem, and a size of the eyelash bonding portion along the extending direction of the eyelash stem is larger than a size of the eyelash bonding portion along the extending direction of the eyelash; the eyelash bonding portion is an elliptical cylinder, an axis of the eyelash bonding portion is arranged perpendicular to the false eyelash, a major axis of the elliptical cylinder is set along the extending direction of the eyelash stem, and a minor axis of the elliptical cylinder is set along the extending direction of the eyelashes; or, the eyelash bonding portion is a strip structure, and the strip structure is extended along the extending direction of the eyelash stem and arranged on the plurality of false eyelashes near the eyelash stem.

As used herein, the term "extension direction" and the term "length direction" have the same meaning and are interchangeable.

In some embodiments of the present application, as the density of the false eyelash increases, a ratio of the size of the eyelash bonding portion along the extending direction of the false eyelash to the size of the eyelash bonding portion along the extending direction of the eyelash stem increases.

A glue pre-application device, which is configured to produce the false eyelash pre-applied with glue described above, comprising a workbench, a glue-applying assembly, a lateral movement assembly, a longitudinal movement assembly, a visual identification assembly and a control module, wherein the workbench is configured to carry the false eyelash body; the glue-applying assembly is arranged above the workbench, and the glue-applying assembly can move along a vertical direction relative to the workbench; the lateral movement assembly is connected to the glue-applying assembly, and the lateral movement assembly can drive the glue-applying assembly to move laterally relative to the workbench; the longitudinal movement assembly is connected to the lateral movement assembly, and the longitudinal movement assembly can drive the lateral movement assembly to move longitudinally relative to the workbench; the visual identification assembly is configured to identify shape information of the false eyelash body on the workbench; and the control module is electrically connected to the visual identification assembly, and the control module obtains corresponding glue-applying mode information through matching according to the shape information of the false eyelash body; and according to the glue-applying mode information, the control module controls the lateral movement assembly and the longitudinal movement assembly to drive the glue-applying assembly to move to a target position for glue application.

In some embodiments of the present application, the lateral movement assembly comprises a lateral motor, a lateral screw, a lateral nut and a lateral support portion, the lateral motor is arranged on the lateral support portion, the lateral motor drives the lateral screw to rotate, the lateral screw drives the lateral nut to move along the lateral screw, and the glue-applying assembly is connected to the lateral nut; the longitudinal movement assembly comprises a longitudinal motor, a longitudinal screw, a longitudinal nut and a longitudinal support portion, the longitudinal motor is arranged on the longitudinal support portion, the longitudinal motor drives the longitudinal screw to rotate, the longitudinal screw drives the longitudinal nut to move along the longitudinal screw, and the lateral support portion is connected to the longitudinal nut; the glue-applying assembly comprises a vertical driving component, a glue storage assembly and a glue nozzle, the glue storage assembly communicates with the glue nozzle, the glue storage assembly is configured to store a hot-melt adhesive mixture, the hot-melt adhesive mixture can be conveyed from the glue storage assembly to the glue nozzle, and the vertical driving component can drive the glue nozzle to move along a vertical direction relative to the false eyelash body; the glue nozzle is configured to apply the eyelash bonding portion to the false eyelash, or the glue nozzle is configured to apply the eyelash stem bonding portion to the eyelash stem.

A method for producing a false eyelash pre-applied with glue, in which the pre-coating device described above is used to produce the false eyelash pre-applied with glue described above, the method comprising:

mixing a pressure-sensitive hot-melt adhesive, anhydrous ethanol and a color concentrate at a ratio to form the hot-melt adhesive mixture, and heating the hot-melt adhesive mixture to a specified temperature by a heating device;

conveying the hot-melt adhesive mixture into the glue-applying assembly through a glue supply pipeline;

entering shape information of various false eyelash bodies into the control module, and matching different glue-applying mode information for different shape information in the control module;

by the visual identification assembly, identifying the shape information of the false eyelash body on the workbench, and feeding back the identified shape information of the false eyelash body to the control module, by the control module, obtaining gluing mode information corresponding to the false eyelash body through matching;

according to the glue-applying mode information, by the control module, controlling the lateral motor and the longitudinal motor to start, and driving the glue nozzle to move to a target position; and by the control module, controlling the vertical driving component to start, and by the vertical driving component, driving the glue nozzle to drop to a target height for glue application.

In some embodiments of the present application, when 50 false eyelashes or fewer are distributed on the eyelash stem with a length of 0.5 cm to 1 cm, the heating device needs to heat the hot-melt adhesive mixture to 140 degrees; when 50 to 80 false eyelashes are distributed on the eyelash stem with the length of 0.5 cm to 1 cm, the heating device needs to heat the hot-melt adhesive mixture to 150 degrees; when 80 to 100 false eyelashes are distributed on the eyelash stem with the length of 0.5 cm to 1 cm, the heating device needs to heat the hot-melt adhesive mixture to 160 degrees.

In some embodiments of the present application, a weight ratio of the pressure-sensitive hot-melt adhesive to the color concentrate in the hot-melt adhesive mixture is in a range of 25:2 to 25:3.

In some embodiments of the present application, when 50 false eyelashes or fewer are distributed on the eyelash stem with a length of 0.5 cm to 1 cm, a length of the eyelash bonding portion extending along a length direction of the false eyelash is 0.03 mm to 0.2 mm; when 50 to 100 false eyelashes are distributed on the eyelash stem with the length of 0.5 cm to 1 cm, the length of the eyelash bonding portion extending along the length direction of the false eyelash is 0.05 mm to 0.3 mm; when 100 to 200 false eyelashes are distributed on the eyelash stem with the length of 0.5 cm to 1 cm, the length of the eyelash bonding portion extending along the length direction of the false eyelash is 0.1 mm to 0.4 mm; when 200 to 300 false eyelashes are distributed on the eyelash stem with the length of 0.5 cm to 1 cm, the length of the eyelash bonding portion extending along the length direction of the false eyelash is 0.12 mm to 0.45 mm; when 300 to 500 false eyelashes are distributed on the eyelash stem with the length of 1 cm to 2 cm, the length of the eyelash bonding portion extending along the length direction of the false eyelash is 0.15 mm to 0.5 mm; when 500 to 800 false eyelashes are distributed on the eyelash stem with a length of 2 cm to 3 cm, the length of the eyelash bonding portion extending along the length direction of the false eyelash is 0.2 mm to 0.55 mm.

Compared with prior art, the advantages and positive effects of the present invention are as follows:

By arranging the eyelash bonding portion on the upper surface of the false eyelash facing the warping direction near the eyelash stem, the false eyelash body can be directly bonded below the real eyelash, the warping directions of the false eyelash and the real eyelash are the same, and the eyelash stem can abut against the connection between the real eyelash and the eyelid, so that the false eyelash can be closely attached to the real eyelash. Therefore, the glue is pre-applied on the false eyelash before leaving the factory, and the wearer does not need to apply glue again during wearing, which saves time and effort. Moreover, the amount of glue applied is appropriate, which improves the wearing experience of the wearer.

By arranging the eyelash bonding portion on the lower surface of the false eyelash facing the warping direction near the eyelash stem, the eyelash stem bonding portion is arranged at the eyelash stem, so that the false eyelash body can be directly bonded above the real eyelash, Moreover, since the false eyelash is bonded above the real eyelash, it is easy to separate the eyelash stem from the real eyelash. The bonding effect of the false eyelash can be ensured by arranging the eyelash stem bonding portion. Therefore, the glue is pre-applied on the false eyelash before leaving the factory, and the wearer does not need to apply glue again during wearing, which saves time and effort. Moreover, the amount of glue applied is appropriate, which improves the wearing experience of the wearer.

The shape information of the false eyelash body placed on the workbench is identified and classified by arranging the visual identification assembly, different glue-applying mode information is matched, and glue is applied to the false eyelash body by the glue-applying assembly to obtain the false eyelash pre-applied with glue.

According to information such as the density of false eyelash, different glue-applying mode information is matched, and glue is applied by the glue pre-application device, so that the wearer has a good wearing experience.

Other features and advantages of the present invention will become more apparent after reading the detailed description of the present invention with reference to the drawings.

BRIEF DESCRIPTION OF FIGURES

In order to more clearly illustrate the technical solutions in the embodiments of the present invention, the drawings needed to be used in the embodiments will be briefly described below. Obviously, the drawings in the following description are some embodiments of the present invention, and other drawings can be obtained by those of ordinary skill in the art from these without any creative efforts.

Figure 1:
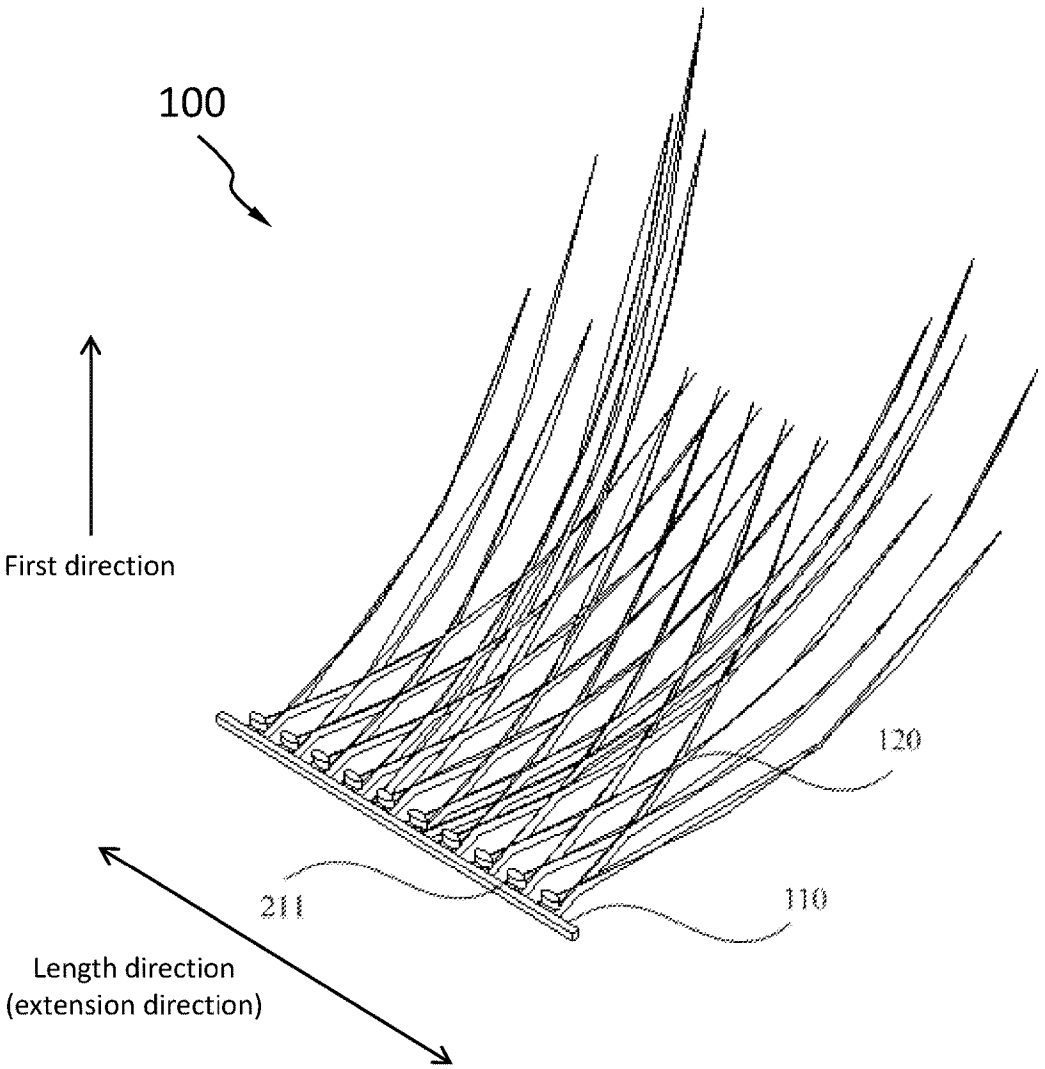
FIG. 1 is a schematic diagram of an overall structure of a false eyelash pre-applied with glue proposed in Embodiment 1 of the present invention.
Figure 2:
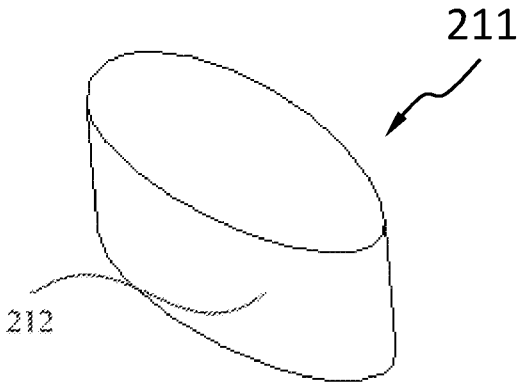
FIG. 2 is a schematic diagram of an overall structure of a glue dispensing column of the false eyelash pre-applied with glue proposed in Embodiment 1 of the present invention.
Figure 3:
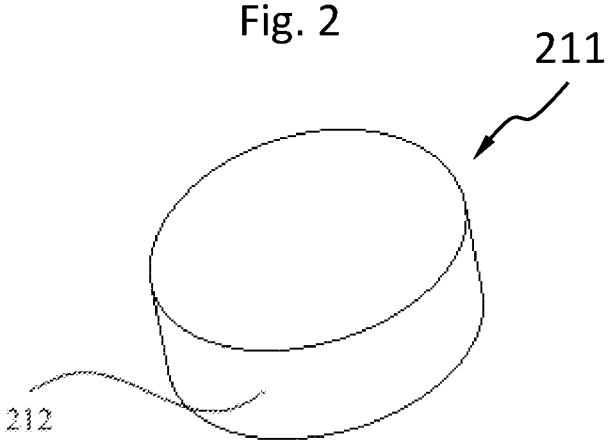
FIG. 3 is a schematic diagram of another overall structure of the glue dispensing column of the false eyelash pre-applied with glue proposed in Embodiment 1 of the present invention.

In the figures,

100, false eyelash body;
110, eyelash stem;
120, false eyelash;
211, glue dispensing column;
212, bonding surface;
213, glue-blading strip-shaped column;
220, eyelash stem bonding portion;
310, workbench;
320, glue-applying assembly;
321, glue nozzle;
322, glue storage cylinder;
323, glue conveying pipe;
331, lateral support portion;
341, longitudinal support portion;
350, visual identification assembly;
360, control module;
370, frame body;
380, vertical support column; and
390, guide assembly.

DETAILED DESCRIPTION

The technical solutions in the embodiments of the present application will be clearly and completely described below with reference to the drawings in the embodiments of the present application. Obviously, the described embodiments are only a part of the embodiments of the present application, and not all the embodiments. All other embodiments obtained by those of ordinary skill in the art on the basis of the embodiments of the present application without creative efforts are all within the scope of the present application.

In the description of the present application, it should be understood that the orientation or positional relationships indicated by the terms "central", "upper", "lower", "front", "rear", "left", "right", "vertical", "horizontal", "top", "bottom", "inner", "outer", etc. are based on the orientation or positional relationships shown in the relevant figures, which is merely for the convenience of describing the present application and simplifying the description, and does not indicate or imply that the mentioned device or element must have a particular orientation and be constructed and operated in the particular orientation. Therefore, the above-mentioned terms cannot be construed as a limitation of the present application.

The terms "first" and "second" are only used for the purpose of description, and cannot be understood as indicating or implying relative importance or implicitly indicating the number of indicated technical features. Thus, the features defined with "first" and "second" may explicitly or implicitly include one or more of the features. In the description of the present application, unless otherwise specified, "a plurality" means two or more.

In the description of the present application, it should be noted that unless otherwise clearly specified and defined, the terms such as "installed," "connected" and "connection" should be understood in a broad sense. For example, "connection" may be a fixed connection, or may be a detachable connection, or may be an integral connection; it may be a mechanical connection, or may be a direct connection, or may be an indirect connection through an intermediate medium. For those of ordinary skill in the art, the specific meanings of the aforementioned terms in the present application can be understood according to specific situations.

In the present invention, unless expressly stipulated and defined otherwise, a first feature being "above" or "below" a second feature may include the first feature being in direct contact with the second feature, or may include the first feature being in contact with the second feature through other features between them instead of direct contract. Moreover, a first feature being "over", "above" and "on the top of" the second feature includes the first feature being directly above and obliquely above the second feature, or simply indicates that the first feature has a horizontal height higher than that of the second feature. The first feature being "under", "below", and "on the bottom of" the second feature includes the first feature being directly below and obliquely below the second feature, or simply indicates that the first feature has a horizontal height lower than that of the second feature.

The following disclosure provides many different embodiments or examples so as to realize different structures of the present invention. In order to simplify the disclosure of the present invention, the components and arrangements of specific examples are described below. Of course, they are only examples, and are not intended to limit the present invention. In addition, the present invention may repeat reference numerals and/or reference letters in different examples, and this repetition is for the purpose of simplification and clarity, and does not indicate the relationship between various embodiments and/or arrangements as discussed.

Embodiment 1

This embodiment relates to a false eyelash pre-applied with glue. As shown in FIGS. 1, 4, 6, 7 and 8, the false eyelash pre-applied with glue includes a false eyelash body 100 and an eyelash bonding portion. The false eyelash body 100 includes an eyelash stem 110 and a plurality of false eyelashes 120 connected thereto. The false eyelashes 120 are warped toward upper surfaces of the false eyelashes 120.

The false eyelash body 100 is bonded to the bottoms of a plurality of real eyelashes from the bottoms of the real eyelashes through the eyelash bonding portion.

Specifically, the plurality of false eyelashes 120 may be connected to the eyelash stem 110 in layers. The eyelash bonding portion is connected to the uppermost false eyelashes.

Since the false eyelash body 100 is bonded to the bottoms of the real eyelashes from the bottoms of the real eyelashes, and the warping direction of the false eyelashes 120 is upward, that is, the false eyelashes 120 are warped toward the real eyelashes, the eyelash stem 110 can closely abut against the real eyelashes and the skin of an eyelid without separation. Therefore, there is no need to arrange a bonding portion at the eyelash stem 110.

In this embodiment, there may be a plurality of eyelash bonding portions. The plurality of eyelash bonding portions are arranged on the plurality of false eyelashes 120 at intervals along the extending direction of the eyelash stem 110.

The size of the eyelash bonding portion along the extending direction of the eyelash stem 110 is larger than the size of the eyelash bonding portion along the extending direction of the false eyelash 120.

In the process of bonding the false eyelash body 100 to the real eyelashes, as shown in FIGS. 2, 3, 5 and 6, a vertical surface of the eyelash bonding portion perpendicular to the false eyelashes 120 is a bonding surface 212 of the eyelash bonding portion with the real eyelashes.

Since the height perpendicular to the false eyelashes 120 on the bonding surface 212 should not be too large, if the height is too large, the distances between the false eyelashes 120 and the real eyelashes will be relatively large, which will affect the visual aesthetics.

Therefore, the size of the bonding surface 212 along the extending direction of the eyelash stem 110 plays a very important role in the tightness of bonding between the real eyelashes and the false eyelashes 120.

Therefore, in order to reduce the amount of pre-applied glue, reduce the cost of glue application, and improve the wearing experience of the wearer, it is necessary to reduce the size of the eyelash bonding portion along the extending direction of the false eyelashes 120 while ensuring the size of the eyelash bonding portion along the extending direction of the eyelash stem 110.

The size of the eyelash bonding portion along the extending direction of the eyelash stem 110 is larger than the size of the eyelash bonding portion along the extending direction of the false eyelash 120.

As the density of false eyelashes increases, the amount of pre-applied glue required increases. After the size of the eyelash bonding portion along the extending direction of the eyelash stem 110 increases to a certain size, if it continues to increase, it will cause the wearer to have a foreign body sensation. At this time, the size of the eyelash bonding portion along the extending direction of the false eyelashes may be increased.

Specifically, a glue dispensing column 211 is shown in FIGS. 1, 2, 3 and 7. The glue dispensing column 211 may adopt an elliptical cylinder structure. An axis of the elliptical cylinder is perpendicular to a surface where the false eyelashes 120 are distributed.

The major axis of the elliptical cylinder is set along the extending direction of the eyelash stem 110. The minor axis of the elliptical cylinder is arranged along the extending direction of the false eyelashes 120.

Figure 4:
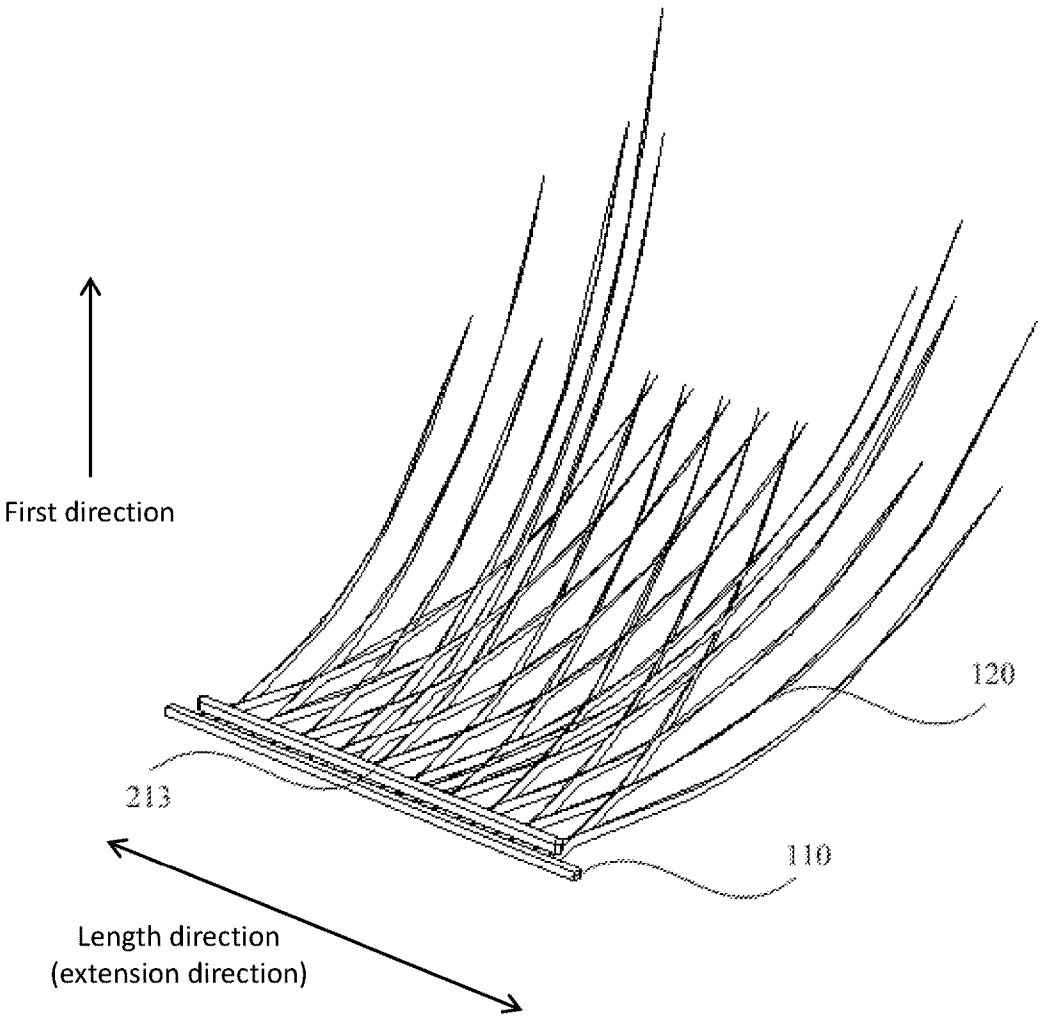
FIG. 4 is a schematic diagram of another overall structure of the false eyelash pre-applied with glue proposed in Embodiment 1 of the present invention.
Figure 5:
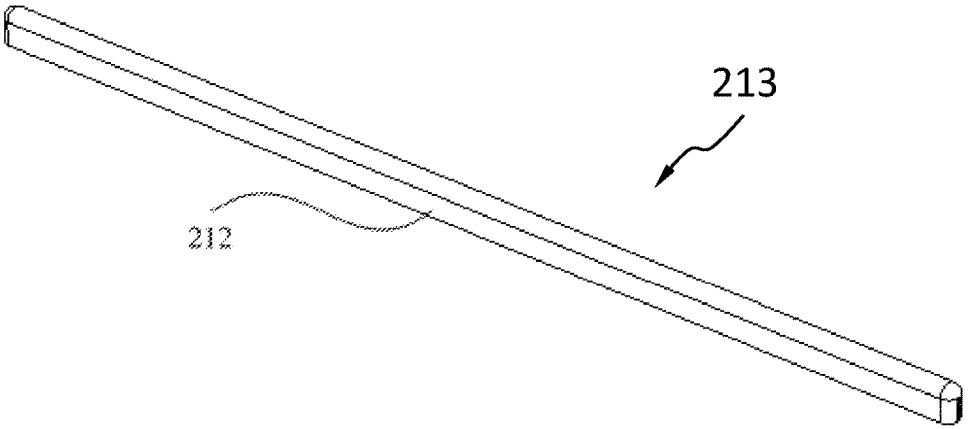
FIG. 5 is a schematic diagram of an overall structure of a glue-blading strip-shaped column of the false eyelash pre-applied with glue proposed in Embodiment 1 of the present invention.
Figure 6:
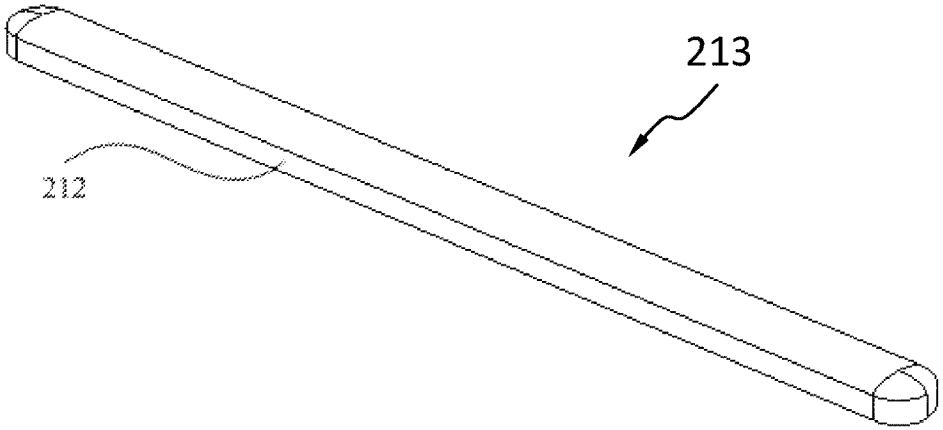
FIG. 6 is a schematic diagram of another overall structure of the glue-blading strip-shaped column of the false eyelash pre-applied with glue proposed in Embodiment 1 of the present invention.
Figure 7:
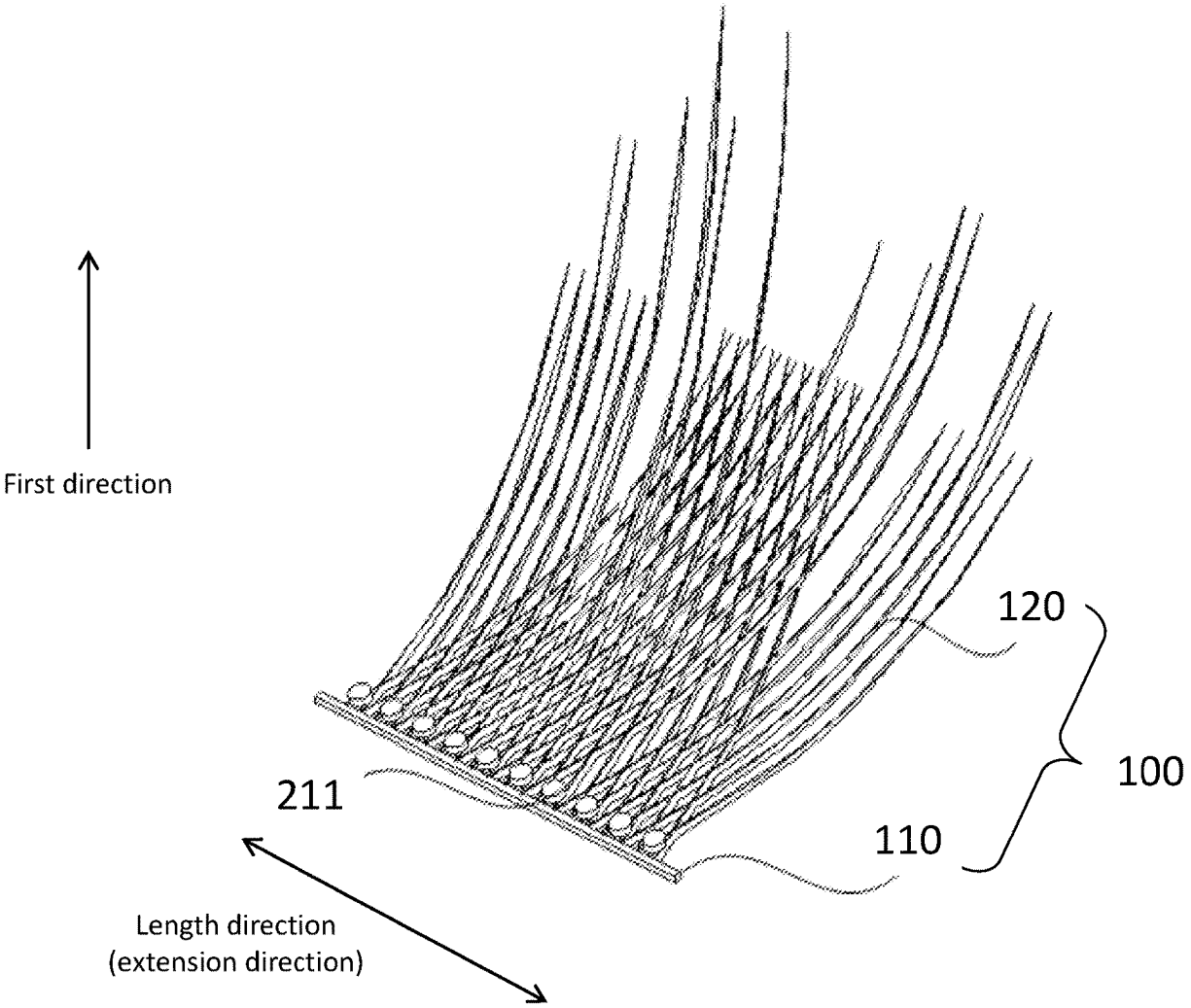
FIG. 7 is a schematic diagram of still another overall structure of the false eyelash pre-applied with glue proposed in Embodiment 1 of the present invention.
Figure 8:
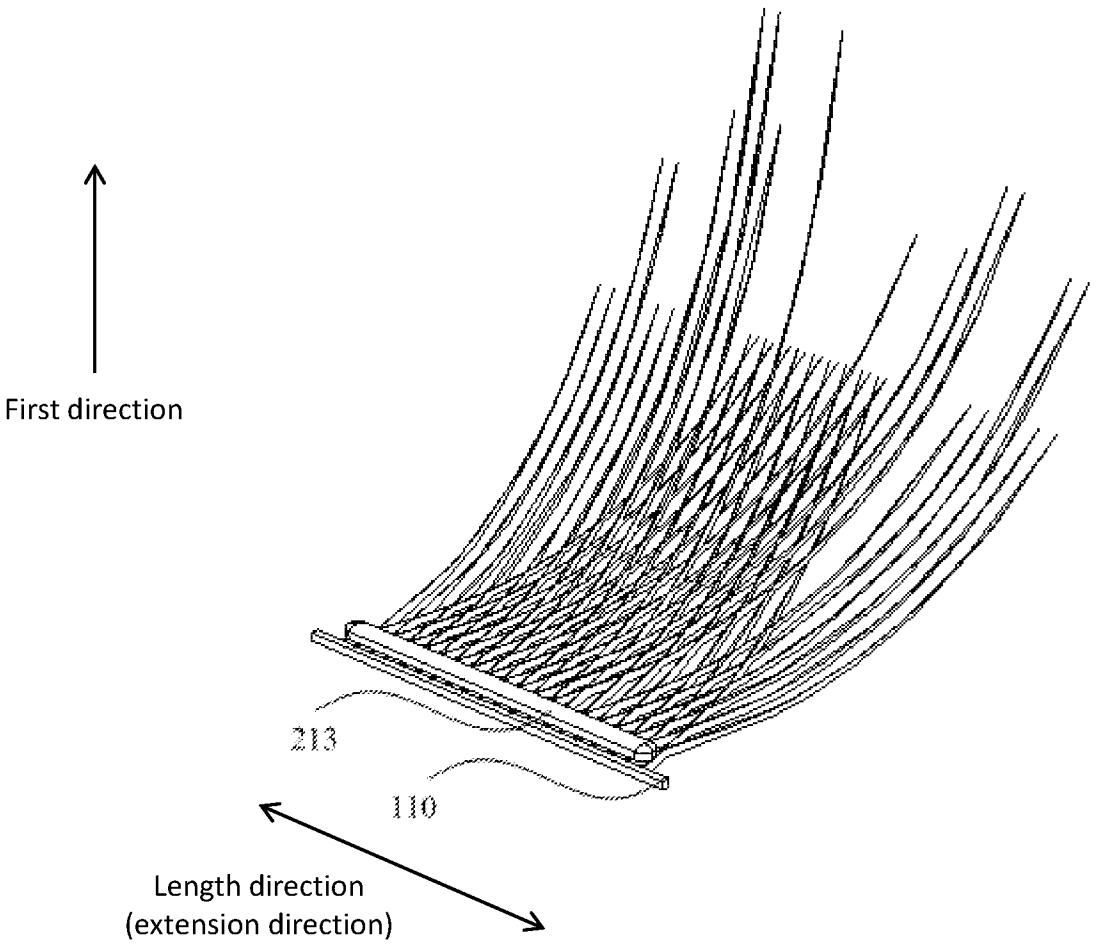
FIG. 8 is a schematic diagram of yet another overall structure of the false eyelash pre-applied with glue proposed in Embodiment 1 of the present invention.

In some other embodiments, as shown in FIGS. 4, 5 and 6, there is one eyelash bonding portion, and the eyelash bonding portion extends along the extending direction of the eyelash stem 110 and is arranged on the plurality of false eyelashes 120 near the eyelash stem 110.

Specifically, the eyelash bonding portion is a glue-blading strip-shaped column 213. At this time, the size of the strip-shaped structure along the extending direction of the false eyelashes 120 increases with the increase of the density of the eyelashes.

Figure 9:
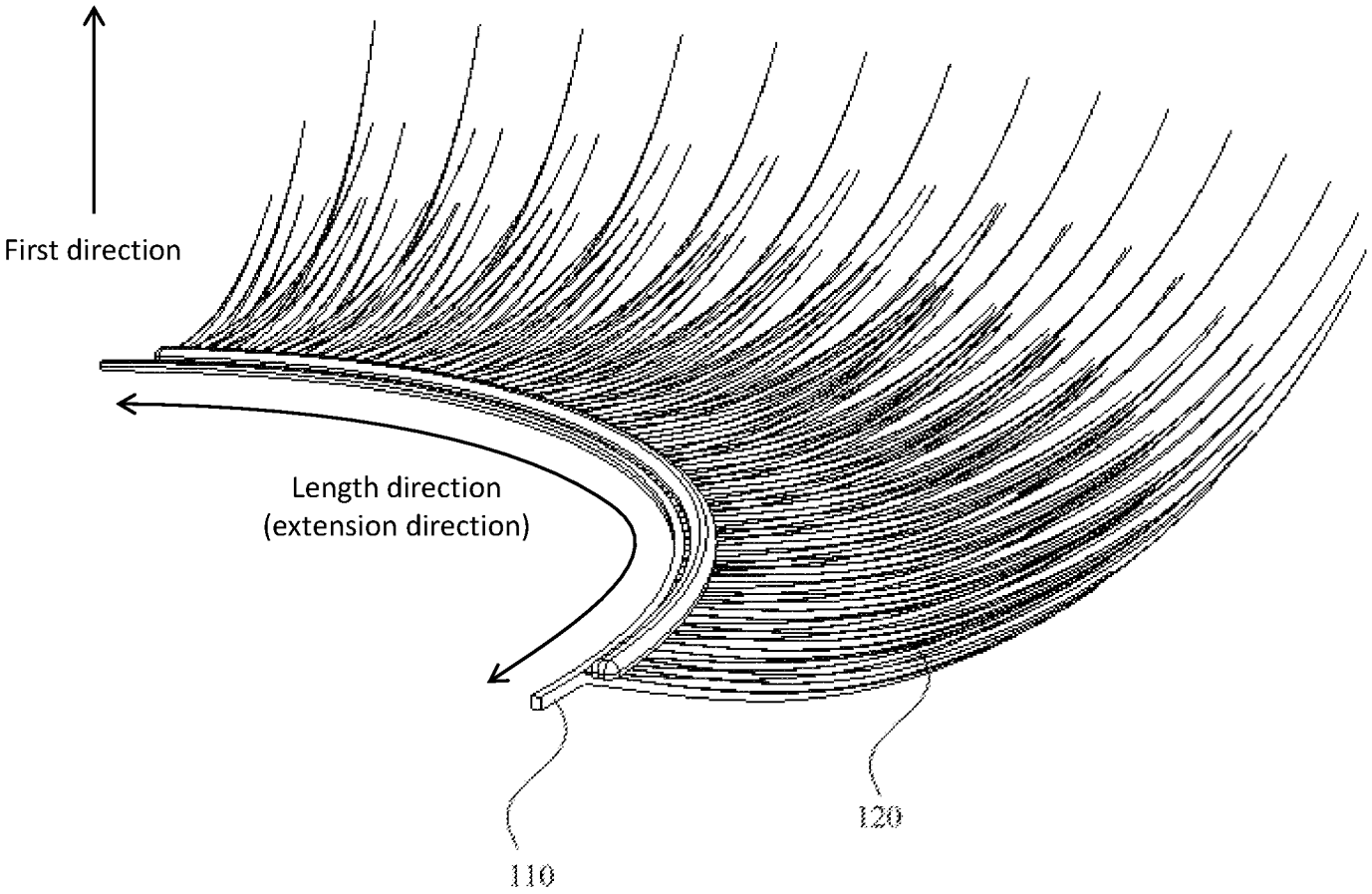
FIG. 9 is a schematic diagram of an overall structure of pairs of eyelashes of the false eyelash pre-applied with glue proposed in Embodiment 1 of the present invention.
Figure 10:
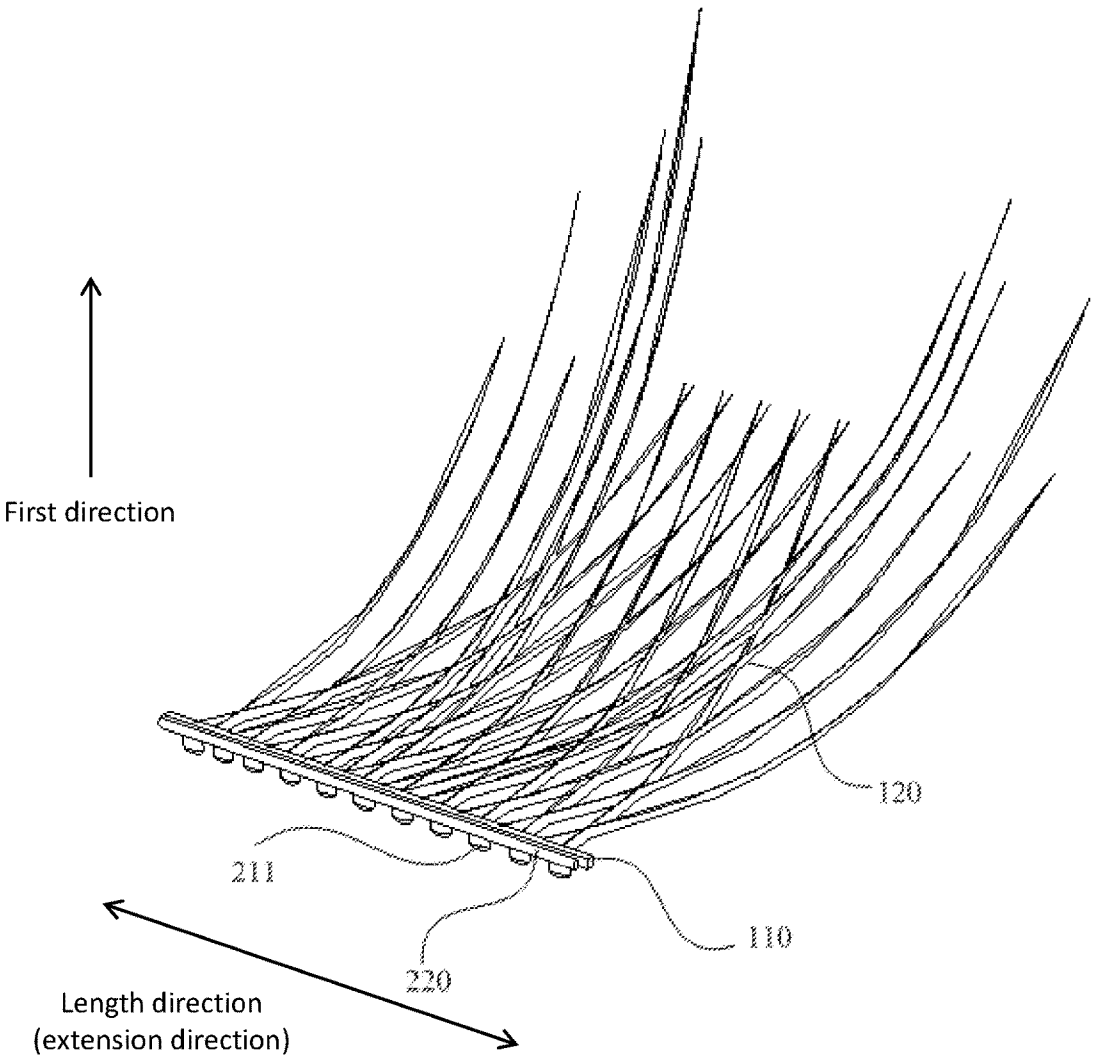
FIG. 10 is a schematic diagram of an overall structure of a false eyelash pre-applied with glue proposed in Embodiment 2 of the present invention.
Figure 11:
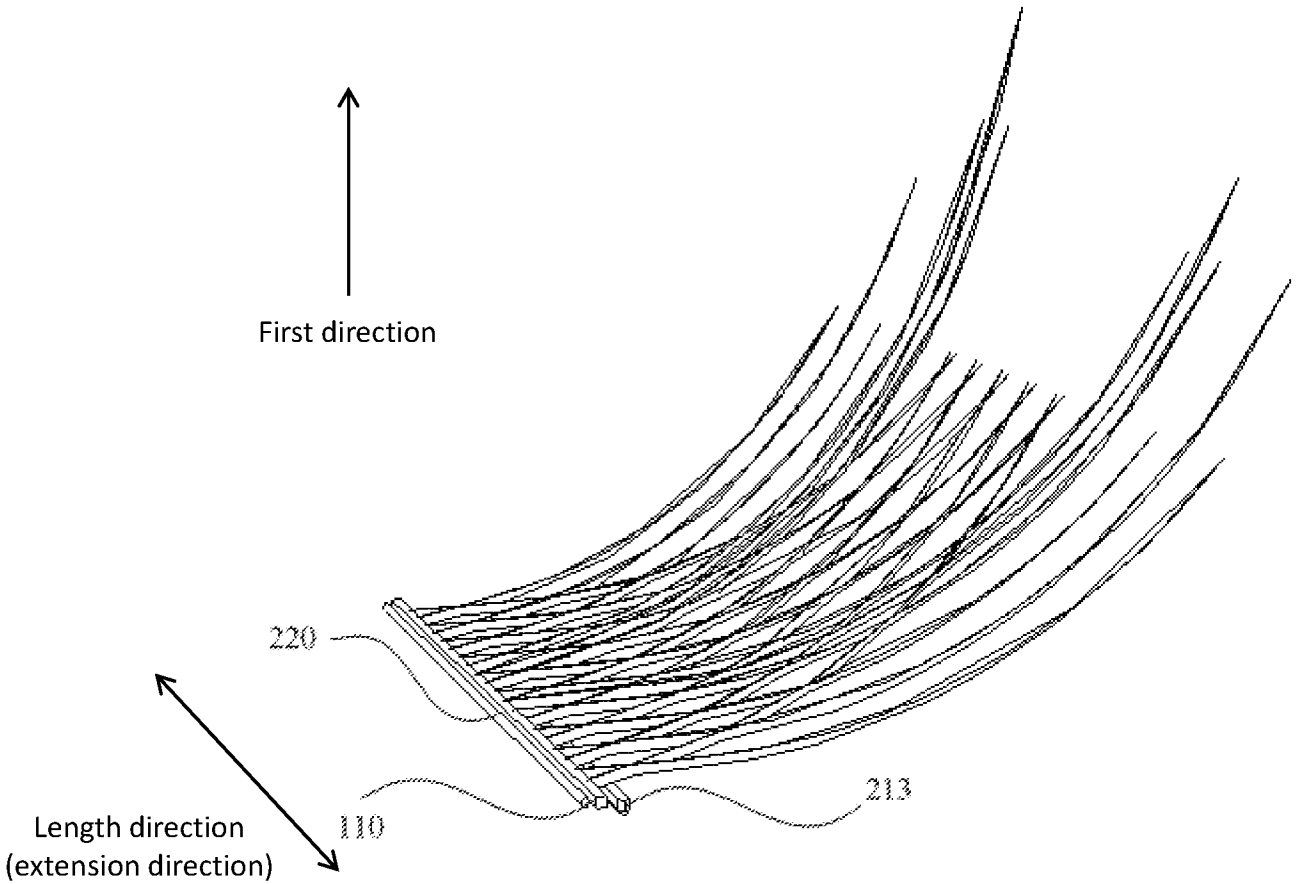
FIG. 11 is a schematic diagram of another overall structure of the false eyelash pre-applied with glue proposed in Embodiment 2 of the present invention.
Figure 12:
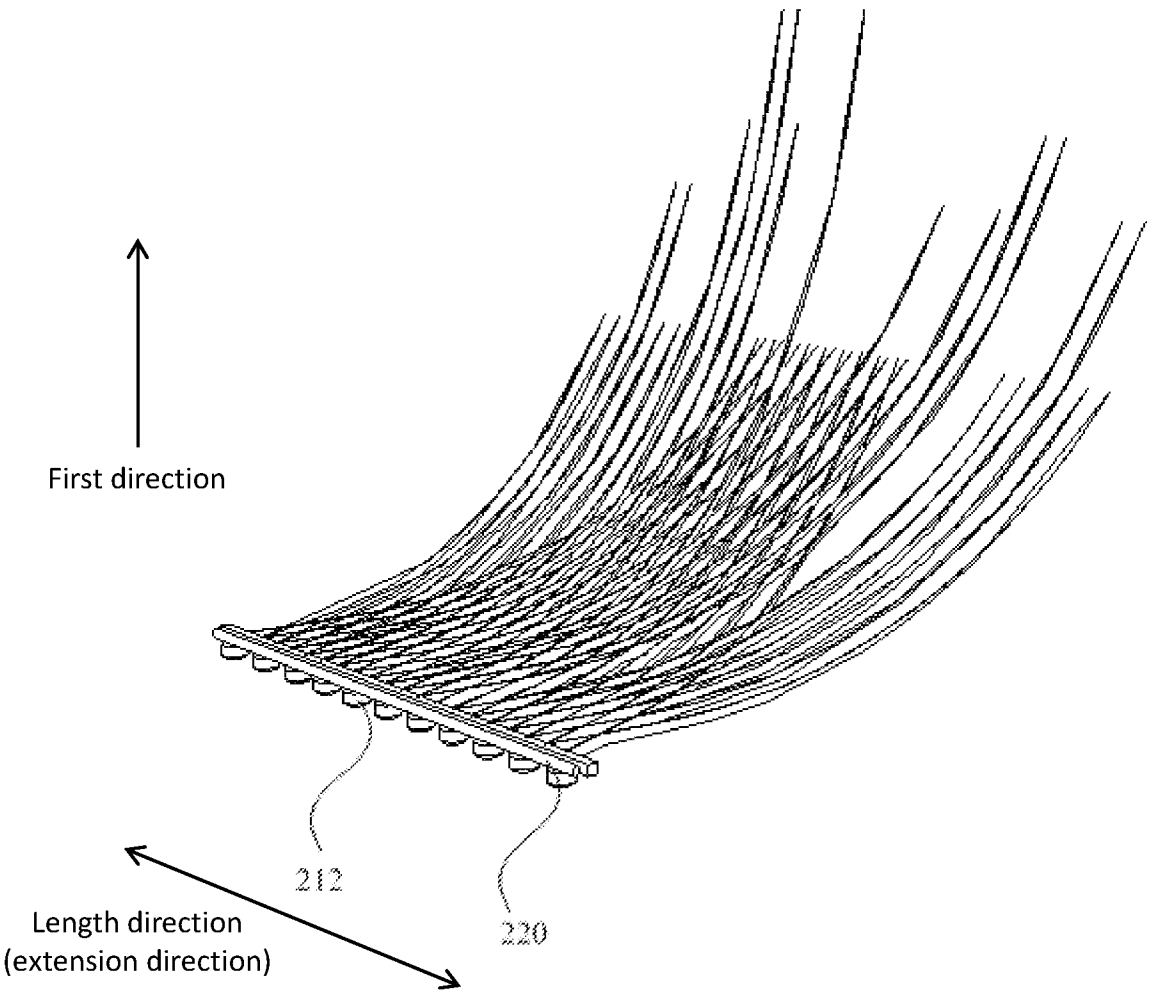
FIG. 12 is a schematic diagram of still another overall structure of the false eyelash pre-applied with glue proposed in Embodiment 2 of the present invention.
Figure 13:
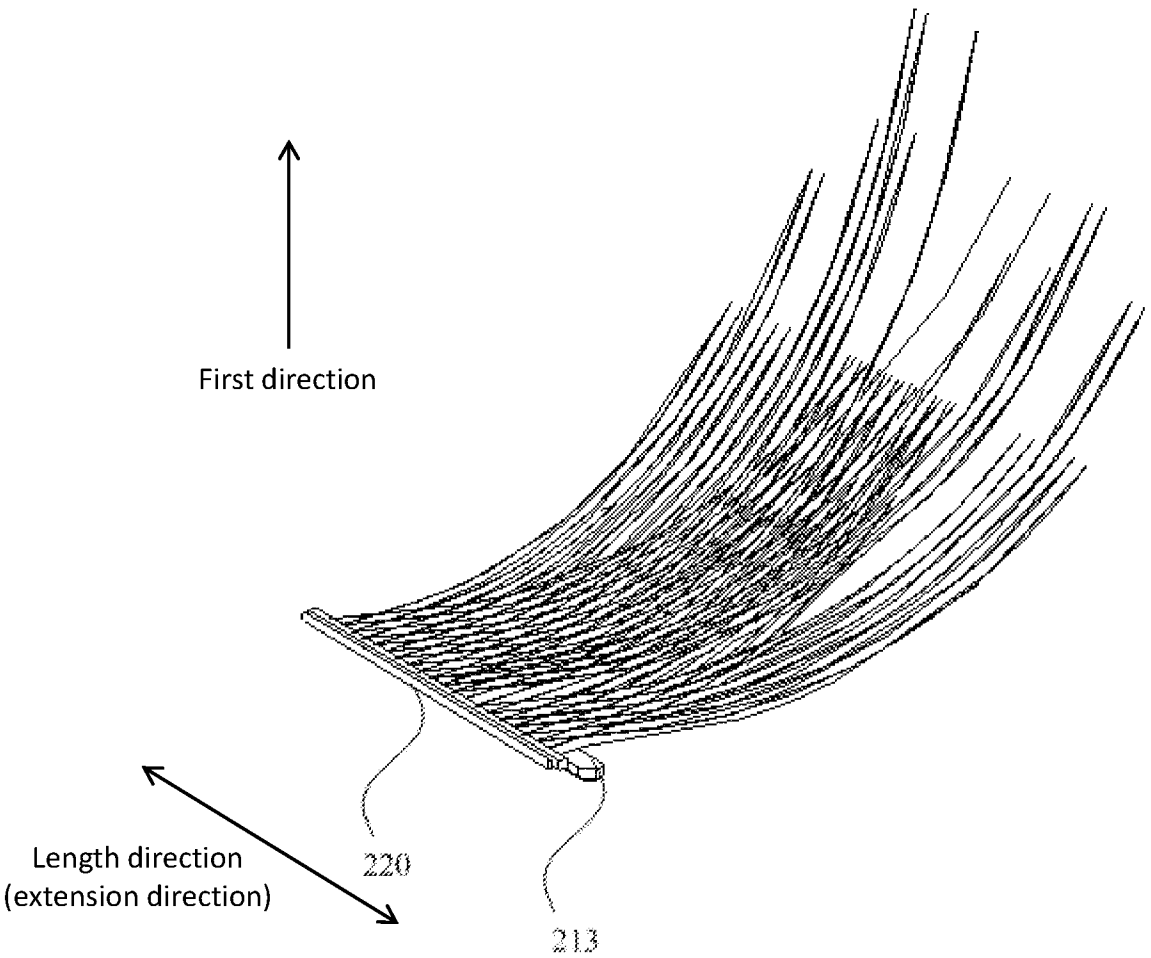
FIG. 13 is a schematic diagram of yet another overall structure of a false eyelash pre-applied with glue proposed in Embodiment 2 of the present invention.

In this embodiment, the false eyelash body 100 is a segmented eyelash. As shown in FIG. 9, in some other embodiments, the false eyelash body 100 may also be pairs of eyelashes.

Embodiment 2

This embodiment relates to a false eyelash pre-applied with glue, as shown in FIGS. 10, 11, 12 and 13. The false eyelash pre-applied with glue includes a false eyelash body 100 and a bonding assembly.

As in Embodiment 1, the false eyelash body 100 includes an eyelash stem 110 and a plurality of false eyelashes 120 connected thereto. The false eyelashes 120 are warped toward upper surfaces of the false eyelashes 120.

The false eyelash body 100 is bonded to the tops of a plurality of real eyelashes from the tops of the real eyelashes through the bonding assembly.

Specifically, the plurality of false eyelashes 120 may be connected to the eyelash stem 110 in layers. The eyelash bonding portion is connected to the uppermost false eyelashes.

Since the false eyelash body 100 is bonded to the tops of the real eyelashes from the tops of the real eyelashes, the warping direction of the false eyelashes 120 is upward, and there is no real eyelash on the top of the false eyelash body 100 to limit it, the eyelash stem 110 cannot closely abut against the connection between the real eyelashes and the skin of an eyelid, resulting in easy separation, etc.

Therefore, in addition to the eyelash bonding portion, the bonding assembly includes an eyelash stem bonding portion 220. The eyelash stem bonding portion 220 is arranged on a side of the eyelash stem 110 away from the false eyelashes 120 along the extending direction of the eyelash stem 110.

Specifically, the eyelash stem bonding portion 220 is a strip-shaped structure.

As in Embodiment 1, there may be a plurality of eyelash bonding portions. The plurality of eyelash bonding portions are arranged below the plurality of false eyelashes 120 at intervals along the extending direction of the eyelash stem 110.

The size of the eyelash bonding portion along the extending direction of the eyelash stem 110 is larger than the size of the eyelash bonding portion along the extending direction of the false eyelash 120.

In the process of bonding the false eyelash body 100 to the real eyelashes, a vertical surface of the eyelash bonding portion perpendicular to the false eyelashes 120 is a bonding surface of the eyelash bonding portion with the real eyelashes.

Since the height perpendicular to the false eyelashes 120 on the bonding surface should not be too large, if the height is too large, the distances between the false eyelashes 120 and the real eyelashes will be relatively large, which will affect the visual aesthetics.

Therefore, the size of the bonding surface along the extending direction of the eyelash stem 110 plays a very important role in the tightness of bonding between the real eyelashes and the false eyelashes 120.

Therefore, in order to reduce the amount of pre-applied glue, reduce the cost of glue application, and improve the wearing experience of the wearer, it is necessary to reduce the size of the eyelash bonding portion along the extending direction of the false eyelashes 120 while ensuring the size of the eyelash bonding portion along the extending direction of the eyelash stem 110.

The size of the eyelash bonding portion along the extending direction of the eyelash stem 110 is larger than the size of the eyelash bonding portion along the extending direction of the false eyelash 120.

As the density of false eyelashes increases, the amount of pre-applied glue required increases. After the size of the eyelash bonding portion along the extending direction of the eyelash stem 110 increases to a certain size, if it continues to increase, it will cause the wearer to have a foreign body sensation. At this time, the size of the eyelash bonding portion along the extending direction of the false eyelashes may be increased.

Specifically, the eyelash bonding portion is a glue dispensing column 211. The glue dispensing column 211 may adopt an elliptical cylinder structure. An axis of the elliptical cylinder is perpendicular to a surface where the false eyelashes 120 are distributed.

The major axis of the elliptical cylinder is set along the extending direction of the eyelash stem 110. The minor axis of the elliptical cylinder is arranged along the extending direction of the false eyelashes 120.

In some other embodiments, there is one eyelash bonding portion, and the eyelash bonding portion extends along the extending direction of the eyelash stem 110 and is arranged on the plurality of false eyelashes 120 near the eyelash stem 110.

Specifically, the eyelash bonding portion is a glue-blading strip-shaped column 213. At this time, the size of the strip-shaped structure along the extending direction of the false eyelashes 120 increases with the increase of the density of the eyelashes.

In this embodiment, the false eyelash body 100 is a segmented eyelash. In some other embodiments, the false eyelash body 100 may also be pairs of eyelashes.

Moreover, in this embodiment, the distribution form of the false eyelashes 120 on the eyelash stem 110 is not limited, and it may be a cross distribution, a linear distribution, or a linear and cross mixed distribution.

Embodiment 3

This embodiment relates to a glue pre-application device. The glue pre-application device is configured to produce the false eyelash pre-applied with glue in Embodiment 1 or 2.

Figure 14:
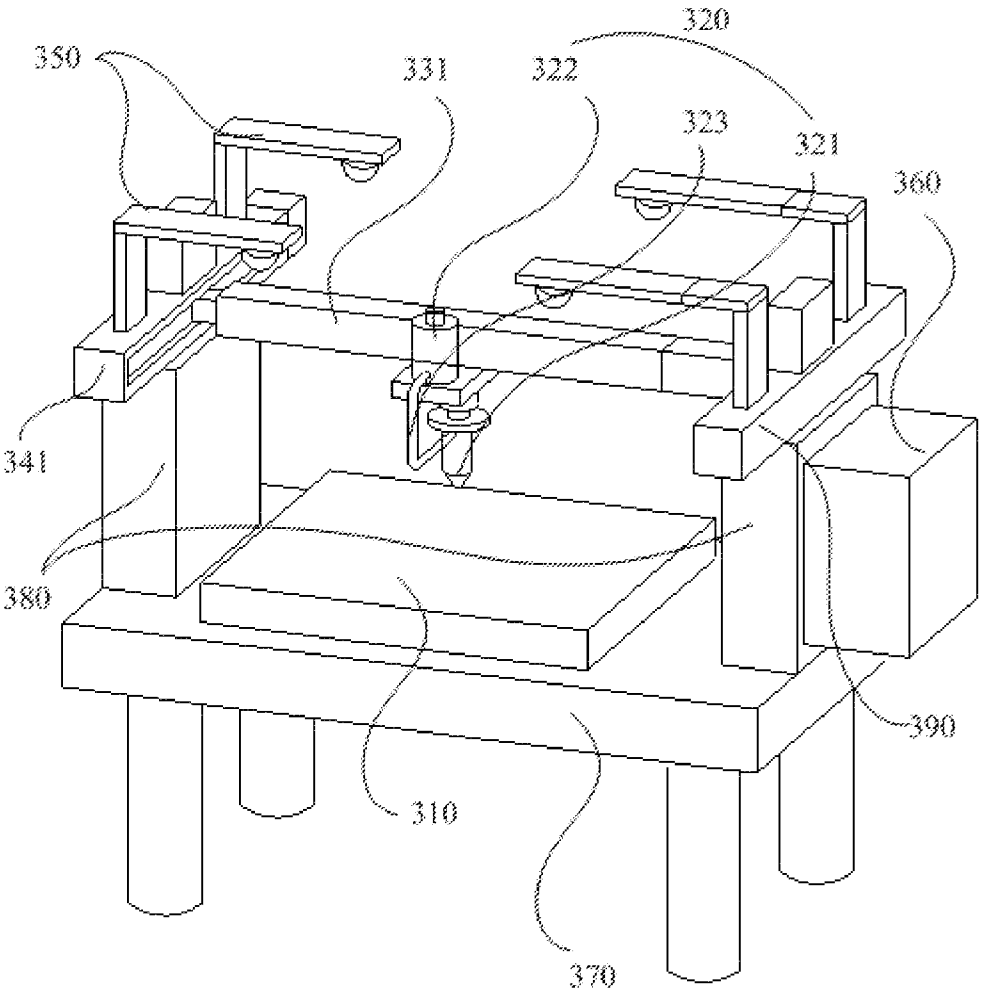
FIG. 14 is a schematic diagram of an overall structure of a false eyelash pre-applied with glue proposed in Embodiment 3 of the present invention.

In this embodiment, as shown in FIG. 14, the glue pre-application device includes a workbench 310, a glue-applying assembly 320, a lateral movement assembly, a longitudinal movement assembly, a visual identification assembly 350 and a control module 360.

The false eyelash body 100 in Embodiment 1 or 2 is placed on the workbench 310, and the workbench 310 is configured to carry the false eyelash body 100.

The glue-applying assembly 320 is arranged above work 310. The glue-applying assembly 320 can move along a vertical direction relative to the working platform 310.

The glue-applying assembly 320 is connected to the lateral movement assembly, and the lateral movement assembly can drive the glue-applying assembly 320 to move laterally relative to the working table 310.

The lateral movement assembly is connected to the longitudinal movement assembly, and the longitudinal movement assembly can drive the lateral movement assembly to move longitudinally relative to the worktable 310.

The visual identification assembly 350 is configured to identify shape information of the false eyelash body 100 on the workbench 310.

The control module 360 is electrically connected to the visual identification assembly 350, and the shape information of the false eyelash body 100 collected by the visual identification assembly 350 is transmitted to the control module 360.

According to the shape information of different types of false eyelash bodies 100, there is one-to-one matched glue-applying mode information in the control module 360.

The glue mode information includes the shapes of the eyelash bonding portion and the eyelash stem bonding portion 220, the amount and position of glue applied, and other information.

According to the glue-applying mode information obtained through matching, The control module 360 controls the lateral movement assembly and the longitudinal movement assembly to drive the glue-applying assembly 320 to move to a target position relative to the false eyelash body 100, and the control module 360 controls the glue-applying assembly 320 to apply glue.

In this embodiment, the lateral movement assembly includes a lateral motor, a lateral screw, a lateral nut and a lateral support portion 331.

Specifically, a first cavity is formed in the lateral support portion 331, and the lateral motor, lateral screw and lateral nut are all arranged in the first cavity.

The lateral motor drives the lateral screw to rotate, the lateral nut is sleeved on the lateral screw, the lateral screw drives the lateral nut to move along the lateral screw, the glue-applying assembly 320 is connected to the lateral nut, and the glue-applying assembly 320 moves with the lateral nut.

Specifically, the lateral screw is arranged to extend along the length direction of the first cavity.

In this embodiment, the longitudinal movement assembly includes a longitudinal motor, a longitudinal screw, a longitudinal nut and a longitudinal support portion 341.

Specifically, a second cavity is formed in the longitudinal support portion 341, and the longitudinal motor, the longitudinal screw and the longitudinal nut are all arranged in the second cavity.

The longitudinal motor drives the longitudinal screw to rotate, the longitudinal nut is sleeved on the longitudinal screw, the longitudinal screw drives the longitudinal nut to move along the longitudinal screw, the lateral support portion 331 is connected to the longitudinal nut, and the lateral movement assembly moves with the longitudinal nut.

In this embodiment, the glue-applying assembly 320 includes a vertical driving component, a glue storage assembly and a glue nozzle 321.

The glue storage assembly includes a glue storage cylinder 322 and a glue conveying pipe 323.

One end of the glue conveying pipe 323 communicates with the glue storage cylinder 322, and the other end of the glue conveying pipe 323 communicates with the glue nozzle 321.

The vertical driving component drives the glue nozzle 321 to move along a vertical direction, so as to realize the glue application action of the glue-applying assembly 320 on the false eyelash body 100.

Specifically, the vertical driving component can adopt an air cylinder.

In this embodiment, the glue-applying assembly 320 further includes a pressure component. The pressure component is configured to apply pressure to a hot-melt adhesive mixture in the glue storage cylinder 322, so as to adjust the glue discharge speed of the glue nozzle 321.

In order to enable the pre-applying device to apply glue conveniently, the eyelash bonding portion has a cross section of an elliptical cylinder as in Embodiments 1 and 2. For example, as described in Embodiment 1, the eyelash bonding portion is a glue dispensing column 211, and the length of the glue dispensing column 211 extending along the false eyelashes 120 is smaller than the length of the glue dispensing column 211 extending along the eyelash stem 110. Correspondingly, the glue nozzle 321 has a duckbill shape, which thus facilitates the output of the elliptical cylindrical eyelash bonding portion.

In order to enable the glue nozzle 321 to apply glue on the false eyelash body 100 from various directions, the glue-applying assembly 320 further includes a universal connector. The universal connector is connected to the glue nozzle 321, and the glue nozzle 321 can realize universal rotation through the universal connector, which is convenient for applying glue to the false eyelash body 100 from multiple directions.

In the process of applying glue to the false eyelash body 100 by the glue-applying assembly 320, the control module 360 controls the pressure assembly to control the pressure of the glue output by the glue nozzle 321 according to the glue mode information obtained through matching, and controls the moving speeds of the lateral motor or the longitudinal motor. Through the matching of the shape of the glue nozzle 321, the output pressure of the pressure component, and the moving speeds of the lateral motor and the longitudinal motor, the eyelash bonding portion or the eyelash stem bonding portion 220 that conforms to the glue mode information is finally output.

In this embodiment, the glue pre-application device further includes a frame body 370, two vertical support columns 380 and a guide assembly 390.

The workbench 310 is arranged on the frame body 370.

The two vertical support columns 380 are oppositely arranged on the frame body 370 on both sides of the workbench 310. The longitudinal movement assembly and the guide assembly 390 are arranged on the two support portion columns 380 arranged oppositely, respectively. The longitudinal movement assembly is arranged parallel to the guide assembly 390.

In this embodiment, the guide assembly 390 includes a guide rail and a slider. The guide rail is arranged parallel to the longitudinal support portion 341.

One end of the lateral support portion 331 is connected to the longitudinal support portion 341, and the other end of the lateral support portion 331 is connected to the slider.

In the process that the longitudinal motor drives one end of the lateral support portion 331 to move relative to the longitudinal support portion 341, the other end of the lateral support portion 331 moves relative to the guide rail.

The visual identification assembly 350 is arranged above the longitudinal support portion 341 and the guide rail.

Specifically, the visual identification assembly 350 includes a camera and a light. The camera is configured to identify shape information of the false eyelash body 100 on the workbench 310, and feed the shape information of the false eyelash body 100 back to the control module 360.

The light is configured to irradiate on the workbench 310 and is configured to supplement light to the false eyelash body 100 on the workbench 310.

Embodiment 4

In this embodiment, it relates to a method for producing a false eyelash pre-applied with glue, in which the glue pre-application device in Embodiment 3 is adopted to perform glue pre-application on a false eyelash body 100, so as to produce the false eyelash pre-applied with glue in Embodiment 1 or 2.

The steps of producing the false eyelash pre-applied with glue are as follows:

S1: A pressure-sensitive hot-melt adhesive, anhydrous ethanol and a color concentrate are mixed at a ratio to form the hot-melt adhesive mixture, and the hot-melt adhesive mixture is heated to a specified temperature by a heating device.

S11: The ratio of the hot-melt adhesive mixture must meet the following requirement:

- a weight ratio of the pressure-sensitive hot-melt adhesive to the color concentrate in the hot-melt adhesive mixture is in a range of 25:2 to 25:3.
- 8 g to 12 g of the color concentrate is added to 100 g of the pressure-sensitive hot-melt adhesive, and at the same time, they are mixed with an appropriate amount of anhydrous ethanol.

Specifically, mixing and matching are as follows:

- when 50 false eyelashes 120 or fewer are distributed on an eyelash stem 110 with a length of 0.1 cm to 0.5 cm, it is required to apply 0.6 g of glue, with 0.35 g of pressure-sensitive hot-melt adhesive, 0.21 g of anhydrous ethanol, and 0.04 g of black color concentrate;
- when 50 to 100 false eyelashes 120 are distributed on the eyelash stem 110 with the length of 0.1 cm to 0.5 cm, it is required to apply 1 g of glue, with 0.55 g of pressure-sensitive hot-melt adhesive, 0.38 g of medical anhydrous ethanol, and 0.06 g of black color concentrate;
- when 100 to 200 false eyelashes 120 are distributed on the eyelash stem 110 with the length of 0.5 cm to 1 cm, it is required to apply 1.6 g of glue, with 0.9 g of pressure-sensitive hot-melt adhesive, 0.56 g of medical anhydrous ethanol, and 0.105 g of black color concentrate;

when 200 to 300 false eyelashes 120 are distributed on the eyelash stem 110 with the length of 0.5 cm to 1 cm, it is required to apply 2 g of glue, with 1.15 g of pressure-sensitive hot-melt adhesive, 0.7 g of anhydrous ethanol, and 0.12 g of black color concentrate;

when 300 to 500 false eyelashes 120 are distributed on the eyelash stem 110 with the length of 1 cm to 2 cm, it is required to apply 2.8 g of glue, with 1.63 g of pressure-sensitive hot-melt adhesive, 1 g of anhydrous ethanol, and 0.17 g of black color concentrate;

when 500 to 800 false eyelashes 120 are distributed on the eyelash stem 110 with the length of 2 cm to 3 cm, it is required to apply 4 g of glue, with 2.33 g of pressure-sensitive hot-melt adhesive, 1.4 g of anhydrous ethanol, and 0.27 g of black color concentrate;

wherein the anhydrous ethanol adopts medical anhydrous ethanol, and the black color concentrate is used for color adjustment.

S12: After mixing according to step S11, a heating device needs to be used for heating. The higher the heating temperature, the more liquid the hot-melt adhesive mixture formed by mixing the pressure-sensitive hot-melt adhesive, anhydrous ethanol and color concentrate tends to be, the stronger the fluidity. When the heating temperature is lower, the hot-melt adhesive mixture tends to be in the form of a solid-liquid mixture.

Specifically, the heating temperature of the hot-melt adhesive mixture is as follows:

when 50 false eyelashes 120 or fewer are distributed on the eyelash stem 110 with a length of 0.5 cm to 1 cm, the heating device needs to heat the hot-melt adhesive mixture to 140 degrees;

when 50 to 80 false eyelashes 120 are distributed on the eyelash stem 110 with the length of 0.5 cm to 1 cm, the heating device needs to heat the hot-melt adhesive mixture to 150 degrees;

when 80 to 100 false eyelashes 120 are distributed on the eyelash stem 110 with the length of 0.5 cm to 1 cm, the heating device needs to heat the hot-melt adhesive mixture to 160 degrees.

The hot-melt adhesive mixture is in the solid form at normal temperature, and it is in a liquid state when heated to a temperature range of 140° C. to 160° C. The higher the heating temperature, the thinner the hot-melt adhesive mixture and the lower the viscosity.

At this time, when the false eyelashes 120 are relatively sparsely distributed on the eyelash stem 110, the plurality of false eyelashes 120 have a less support force for the hot-melt adhesive mixture, the hot-melt adhesive mixture needs to have lower fluidity, and the hot-melt adhesive mixture needs to be thicker, so as to ensure that an eyelash bonding portion with a stable shape can be formed on the sparse false eyelashes 120. Therefore, the heating temperature at this time should not be too high, and it is appropriate to adopt the temperature of 140 degrees.

When the false eyelashes 120 are relatively densely distributed on the eyelash stem 110, the plurality of false eyelashes 120 have a greater support force for the hot-melt adhesive mixture, and the hot-melt adhesive mixture needs to have stronger permeability and higher fluidity, and can penetrate between the plurality of false eyelashes 120, so as to ensure the bonding of the dense false eyelashes 120, and avoiding the layering of multi-layer false eyelashes 120. Therefore, the heating temperature at this time should not be too low, and it is appropriate to adopt the temperature of 160 degrees.

Moreover, when the false eyelashes 120 are relatively dense, if a thicker hot-melt adhesive mixture is used, the wearer will easily have a foreign body sensation during wearing. In addition, because the low-temperature hot-melt adhesive mixture is thicker, it is also difficult to disassemble, which will greatly affect the wearer's use experience.

S13: The heating device is electrically connected to the control module 360, and the control module 360 controls the heating temperature of the heating device.

S2: The heated hot-melt adhesive mixture is conveyed to the glue-applying assembly 320 through the glue supply pipeline.

S21: The output end of the glue supply pipeline communicates with the glue storage cylinder 322, the output end of the glue storage cylinder 322 communicates with the glue delivery pipe 323, and the output end of the glue conveying pipe 323 communicates with the glue nozzle 321.

S22: A control valve is connected to the glue supply pipeline, the control valve is electrically connected to the control module 360, and the control module 360 controls the start or stop of the control valve.

S3: The shape information of various false eyelash bodies 100 is entered into the control module 360, and different glue-applying mode information are matched for different shape information in the control module 360.

S31: The glue mode information includes the shapes of the eyelash bonding portion and the eyelash stem bonding portion 220, the amount and position of applied glue, and other information.

The amount of glue applied increases with the increase of the density of false eyelashes 110 distributed on the eyelash stem 120. Specifically, the corresponding relationship between the density of eyelashes and the amount of glue applied is as follows:

When 50 false eyelashes 120 or fewer are distributed on the eyelash stem 110 with a length of 0.1 cm to 0.5 cm, the amount of glue applied is 0.6 g;

when 50 to 100 false eyelashes 120 are distributed on the eyelash stem 110 with the length of 0.1 cm to 0.5 cm, the amount of glue applied is 1 g;

when 100 to 200 false eyelashes 120 are distributed on the eyelash stem 110 with a length of 0.5 cm to 1 cm, the amount of glue applied is 1.6 g;

when 200 to 300 false eyelashes 120 are distributed on the eyelash stem 110 with the length of 0.5 cm to 1 cm, the amount of glue applied is 2 g;

when 300 to 500 false eyelashes 120 are distributed on the eyelash stem 110 with a length of 1 cm to 2 cm, the amount of glue applied is 2.8 g;

when 500 to 800 false eyelashes 120 are distributed on the eyelash stem 110 with a length of 2 cm to 3 cm, the amount of glue applied is 4 g.

The increase in the amount of glue applied is reflected in the length of the eyelash bonding portion extending along the direction of the false eyelashes 120. Specifically, the increase of the amount of glue applied with the increase of eyelash density is reflected in the length of the eyelash bonding portion extending along the length direction of the false eyelashes 120 by the following corresponding relationship:

When 50 false eyelashes 120 or fewer are distributed on the eyelash stem 110 with a length of 0.5 cm to 1 cm, the length of the eyelash bonding portion extending along the length direction of the false eyelashes 120 is 0.03 mm to 0.2 mm;

when 50 to 100 false eyelashes 120 are distributed on the eyelash stem 110 with the length of 0.5 cm to 1 cm, the length of the eyelash bonding portion extending along the length direction of the false eyelashes 120 is 0.05 mm to 0.3 mm;

when 100 to 200 false eyelashes 120 are distributed on the eyelash stem 110 with the length of 0.5 cm to 1 cm, the length of the eyelash bonding portion extending along the length direction of the false eyelashes 120 is 0.1 mm to 0.4 mm;

when 200 to 300 false eyelashes 120 are distributed on the eyelash stem 110 with the length of 0.5 cm to 1 cm, the length of the eyelash bonding portion extending along the length direction of the false eyelashes 120 is 0.12 mm to 0.45 mm;

when 300 to 500 false eyelashes 120 are distributed on the eyelash stem 110 with a length of 1 cm to 2 cm, the length of the eyelash bonding portion extending along the length direction of the false eyelashes 120 is 0.15 mm to 0.5 mm;

when 500 to 800 false eyelashes 120 are distributed on the eyelash stem 110 with the length of 2 cm to 3 cm, the length of the eyelash bonding portion extending along the length direction of the false eyelashes 120 is 0.2 mm to 0.55 mm.

S4: The visual identification assembly 350 identifies the shape information of the false eyelash body 100 on the workbench 310, and feeds back the identified shape information of the false eyelash body 100 to the control module 360; and the control module 360 obtains glue-applying mode information corresponding to the false eyelash body 100 through matching.

S5: The control module 360 controls the lateral motor and the longitudinal motor to start according to the glue-applying mode information obtained through matching, and drives the glue nozzle 321 to move to a target position.

S6: The control module 360 controls the vertical driving component to start, and the vertical driving component drives the glue nozzle 321 to drop to a target height to apply glue on the false eyelash body 100.

S61: In the process of the glue nozzle 321 dropping to the target height for glue application, according to the glue-applying mode information obtained through matching, the lateral motor or the longitudinal motor drive the glue nozzle 321 to move along the length direction of the false eyelashes 120, wherein the moving distance is determined according to the length of the eyelash bonding portion along the direction of the false eyelashes 120 that is set in the glue-applying mode information.

S62: According to whether the glue dispensing column 211 or the glue-blading strip-shaped column 213 is used as the eyelash bonding portion, which is set in the glue-applying mode information, the control module 360 controls the movement trajectory of the glue nozzle 321 by driving the lateral motor and the longitudinal motor, so that the glue nozzle 321 moves to a target position to match the glue application of the eyelash bonding portion with different shapes at different positions.

S63: According to whether it needs to apply glue to the eyelash stem bonding portion 220, which is set in the glue-applying mode information, if it needs to apply glue to the eyelash stem bonding portion 220, the control module 360 controls the movement and rotation of the glue nozzle 321 to perform glue application on the eyelash stem bonding portion 220.

S7: The vertical driving component drives the glue nozzle 321 to rise, and the lateral motor and the longitudinal motor drive the glue nozzle to move to a next target false eyelash body 100 for glue application.

In the description of the above embodiments, specific features, structures, materials or characteristics may be combined in any one or more embodiments or examples in a suitable manner.

The above is only a detailed description of the preferred embodiments of the present invention, but the scope of protection of the present invention is not limited thereto. Any changes or substitutions, which can be readily conceived of by those skilled in the art within the technical scope disclosed in the present invention, shall be covered within the scope of protection of the present invention. Therefore, the scope of protection of the present invention should be defined by the protection scope of the claims.

What is claimed is:

1. A device comprising:

a false eyelash body comprising an eyelash stem and false eyelashes connected to the eyelash stem, wherein the false eyelashes bend toward a first direction; and an eyelash bonding portion extending along a length direction of the eyelash stem;

wherein the eyelash bonding portion is on first surfaces or second surfaces of the false eyelashes;

wherein the first surfaces face the first direction and the second surfaces face away from the first direction;

wherein the eyelash bonding portion is configured to glue the false eyelash body to real eyelashes of a person;

wherein the eyelash bonding portion comprises multiple discrete sections on the false eyelashes and at intervals along the length direction of the eyelash stem;

wherein the discrete sections are elliptical cylinders;

wherein each of the elliptical cylinders has a height extending in the first direction.

2. The device of claim 1, wherein each of the elliptical cylinders has a major axis along the length direction of the eyelash stem.

3. The device of claim 1, wherein each of the elliptical cylinders has a glue on a lateral surface thereof.

4. The device of claim 3, wherein the glue is a pressure-sensitive glue.

5. The device of claim 1, wherein the eyelash bonding portion is a continuous strip extending along the length direction of the eyelash stem.

6. The device of claim 1, wherein the eyelash bonding portion is configured to glue the false eyelash body to the real eyelashes at a vertical surface of the eyelash bonding portion.

7. A method of making the device of claim 1, comprising:

forming an adhesive mixture by mixing a pressure-sensitive adhesive, ethanol and a coloring agent;

applying the adhesive mixture to the eyelash bonding portion.

* * * * *